US006033292A

United States Patent [19]

Inaba

[11] Patent Number: 6,033,292

[45] Date of Patent: Mar. 7, 2000

[54] WAFER POLISHING APPARATUS WITH RETAINER RING

[75] Inventor: Takao Inaba, Mitaka, Japan

[73] Assignee: Tokyo Seimitsu Co., Ltd., Tokyo, Japan

[21] Appl. No.: 09/084,782

[22] Filed: May 27, 1998

[30] Foreign Application Priority Data

May 28, 1997 [JP] Japan ..... 9-138926

[51] Int. Cl.[7] ..... B24B 5/00

[52] U.S. Cl. ..... 451/288; 451/287

[58] Field of Search ..... 451/287, 288, 451/286, 388, 398

[56] References Cited

U.S. PATENT DOCUMENTS

| | | | |
|---|---|---|---|
| 5,036,630 | 8/1991 | Kaanta et al. . | |
| 5,538,465 | 7/1996 | Netsu et al. | 451/289 X |
| 5,584,751 | 12/1996 | Kobayashi et al. | 451/288 |
| 5,588,902 | 12/1996 | Tominaga et al. | 451/288 |

FOREIGN PATENT DOCUMENTS

| | | |
|---|---|---|
| 8-229808 | 9/1996 | Japan . |
| 9-19863 | 1/1997 | Japan . |
| 9-201763 | 8/1997 | Japan . |

OTHER PUBLICATIONS

Patent Abstracts of Japan, vol. 14, No. 570 (M–1060), Dec. 18, 1990, JP 2–243263 A (Hitachi Ltd.), Abstract.

Database WPIL on Questel, Week 9502, London: Derwent Publications Ltd., AN 95–010404, Class F26B, JP 06–295893 A (Mitsubishi Material Silicon KK and Mitsubishi Materials Corp), Abstract.

*Primary Examiner*—David A. Scherbel
*Assistant Examiner*—Anthony Ojini
*Attorney, Agent, or Firm*—Sixbey, Friedman Leedom & Ferguson; David S. Safran

[57] ABSTRACT

A rubber sheet is arranged between a head body and a retainer ring of a wafer holding head. Two O-rings air-tightly close a space between the periphery of the rubber sheet, which is located above the retainer ring, and the head body. When a pump supplies the compressed air to the space, the periphery of the rubber sheet is elastically deformed to press the retainer ring under uniform pressure.

5 Claims, 7 Drawing Sheets

WAFER POLISHING APPARATUS WITH RETAINER RING

BACKGROUND OF THE INVENTION

1. Field of the Invention

The present invention relates generally to a wafer polishing apparatus, and more particularly to a wafer polishing apparatus which has a retainer ring and presses a wafer against a rotating turn table to polish the wafer whose peripheral edge is enclosed by the retainer ring.

2. Description of Related Art

Japanese Patent Provisional Publication No. 8-229808 discloses a wafer polishing apparatus which has a retainer ring enclosing the periphery of a wafer and presses the retainer ring and the wafer against a turn table to polish the wafer. The wafer polishing apparatus is provided with an annular tube which is arranged between the retainer ring and a wafer holding head. Japanese Patent Provisional Publication No. 8-229808 also discloses a method of adjusting a pressure force of the retainer ring by adjusting the air pressure within the tube, and a method of adjusting the pressure force with use of a diaphragm.

A conventional wafer polishing apparatus, however, cannot uniformly press over the circumference of the retainer ring, since the supply of the air to the tube causes a weak portion thereof to expand excessively. The irregular pressure force causes the polishing pressure against the wafer to be irregular. Thus, the wafer cannot uniformly be polished.

The method of adjusting the pressure force of the retainer ring by means of the diaphragm has a disadvantage because the movable range of the retainer ring is too narrow to obtain a necessary pressure force.

SUMMARY OF THE INVENTION

The present invention has been developed under the above-described circumstances, and has as its object the provision of a wafer polishing apparatus with a retainer ring, in which the apparatus uniformly presses the retainer ring, which is greatly displaced.

To achieve the above-mentioned object, the present invention is directed to a wafer polishing apparatus which presses a wafer against a rotating turn table to polish a face of the wafer, the wafer polishing apparatus comprises: a rotary head body arranged opposite to the turn table; a carrier contained in the head body in a manner that is vertically movable, the carrier supporting the wafer to press the wafer against the turn table; a retainer ring contained in the head body in a manner that is vertically movable, the retainer ring concentrically arranged at the periphery of the carrier, the retainer ring coming into contact with the turn table and holding the periphery of the wafer during polishing; an elastic sheet provided in a space in the head body above the carrier and the retainer ring; a first space which presses the carrier and a second space which presses the retainer ring, the first and second spaces being formed in the head body; and is characterized in that the elastic sheet is concentrically divided into at least a central part included in the first space and a peripheral part included in the second space, and pressure air is supplied to the first and second spaces to elastically deform the central part and the peripheral part of the elastic sheet such that the central part presses the carrier against the turn table and the peripheral part presses the retainer ring against the turn table.

According to the present invention, the wafer polishing apparatus with the retainer ring supplies the pressure air to the first space and elastically deforms the central part of the elastic sheet under the air pressure to press the carrier, thereby pressing the wafer against the polishing pad. Then, the wafer polishing apparatus supplies the pressure air to the second space, and elastically deforms the periphery of the elastic sheet to press the retainer ring, thereby uniformly pressing the retainer ring against the polishing pad. Thus, the present invention uniformly polishes the whole surface of the wafer, and the movement strokes of the retainer ring are longer in the present invention than in the polishing apparatus which uses the diaphragm. For this reason, the retainer ring can be pressed satisfactorily.

Moreover, the present invention is directed to a wafer polishing apparatus which presses a wafer against a rotating turn table to polish a face of the wafer, the wafer polishing apparatus comprises: a rotary head body arranged opposite to the turn table; a carrier contained in the head body in a manner that is vertically movable, the carrier supporting the wafer to press the wafer against the turn table; a retainer ring contained in the head body in a manner that is vertically movable, the retainer ring concentrically arranged at the periphery of the carrier, the retainer ring coming into contact with the turn table and holding the periphery of the wafer during polishing; a sealed first space which presses the carrier and a sealed second space which presses the retainer ring, the first and second spaces being formed in the head body; and is characterized in that pressure air is supplied to the first and second spaces to press the carrier and the retainer ring against the turn table.

According to the present invention, in the wafer polishing apparatus, the pressure air is supplied to the first space to directly press the carrier and the wafer against the polishing pad. The pressure air is supplied to the second space, and the air pressure directly presses the retainer ring, thereby uniformly pressing the whole surface of the wafer. The movement strokes of the retainer ring are longer in the present invention than in the polishing apparatus which uses the diaphragm. For this reason, the retainer ring can be pressed satisfactorily.

According to the present invention, the elastic sheet is made of rubber, metal, or plastic. In other words, it is possible to use any kind of sheets which are elastically deformed by the pressure of the pressure air to press the carrier and the retainer ring.

According to the present invention, the elastic sheet is composed of one sheet, and the number of parts can be reduced as a result.

According to the present invention, the elastic sheet is composed of a circular sheet which is arranged therein, and an annular sheet which is arranged outside the circular sheet.

According to the present invention, the elastic sheet is composed of vertically stacked two elastic sheets. In other words, the two elastic sheets also can form the first and second spaces.

According to the present invention, an air jetting member is provided at the bottom of the carrier and jets the air towards the reverse side of the wafer to thereby form a pressure fluid layer between the carrier and the wafer and press the wafer against the turn table via the pressure fluid layer. Thus, the wafer is uniformly pressed against the turn table, and it is therefore possible to polish the whole surface of the wafer uniformly.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be explained in further detail by way of example with reference to the accompanying drawings.

Figure 1:
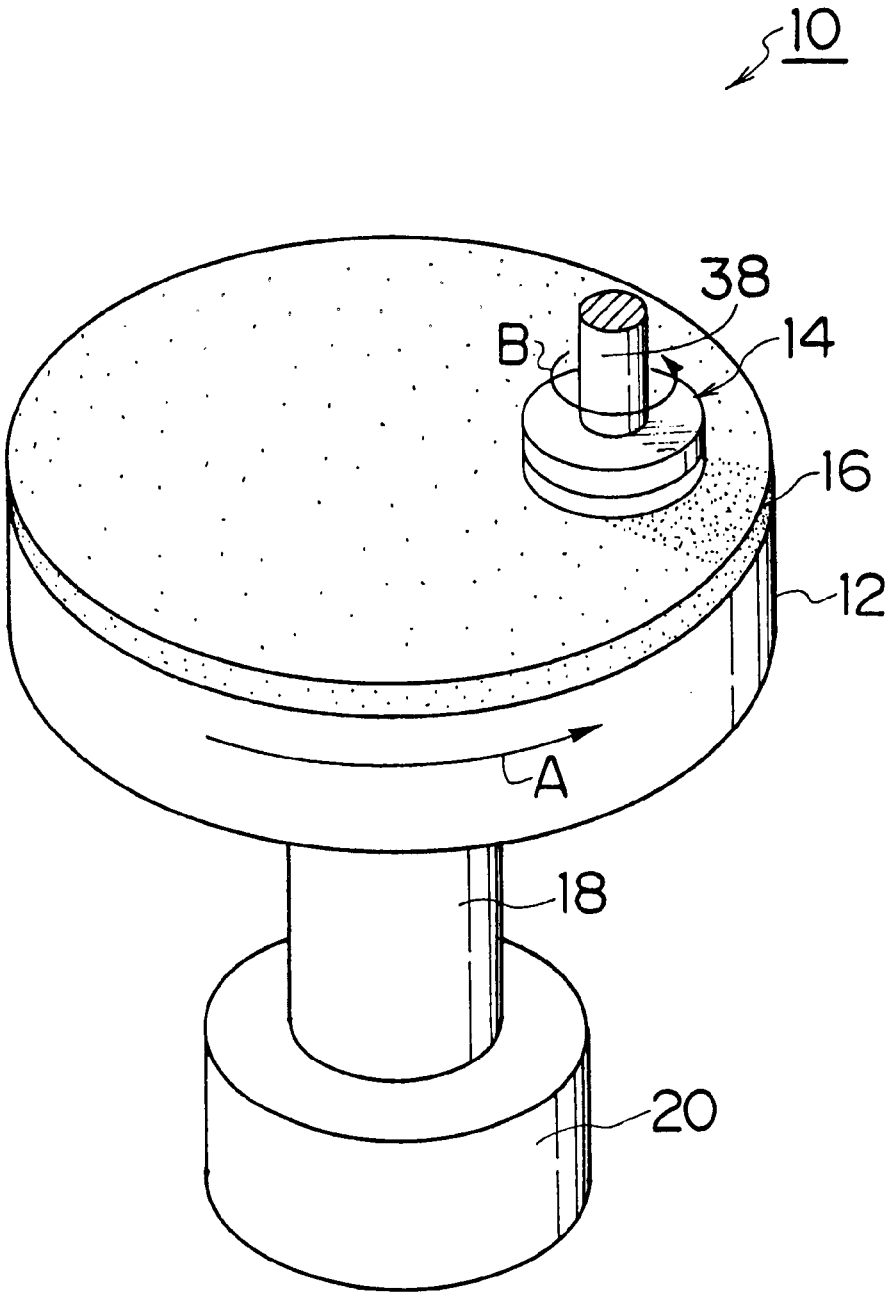
FIG. 1 shows the entire structure of a wafer polishing apparatus with a retainer ring according to the first embodiment.

FIG. 1 shows the entire construction of a wafer polishing apparatus to which a wafer polishing apparatus with a retainer ring according to the present invention is applied.

As shown in FIG. 1, the wafer polishing apparatus 10 is provided with a turn table 12 and a wafer holding head 14. The turn table 12 is disk-shaped, and a polishing pad 16 is attached on the top of the turn table 12. A spindle 18 connects to the bottom of the turn table 12 and an output shaft (not shown) of a motor 20. Driving the motor 20 rotates the turn table 12 in the direction indicated with an arrow A, and slurry is supplied onto the polishing pad 16 on the rotating turn table 12 through a nozzle (not shown).

Figure 2:
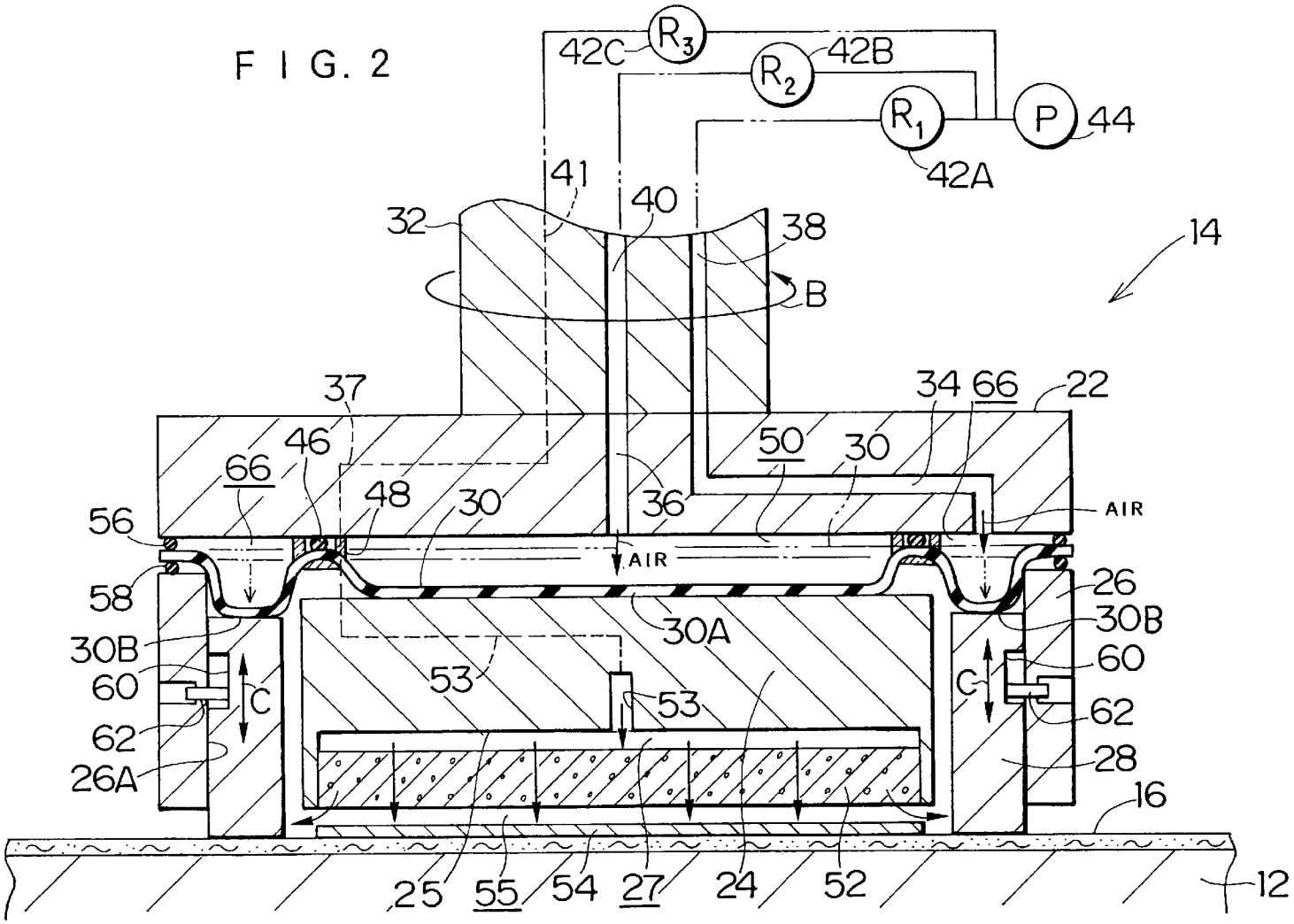
FIG. 2 is a longitudinal sectional view illustrating a wafer holding head of the wafer polishing apparatus in FIG. 1.

FIG. 2 is a longitudinal sectional view of the wafer holding head 14. The wafer holding head 14 comprises a head body 22, a carrier 24, a guide ring 26, a retainer ring 28, and an elastic sheet or a rubber sheet 30. The head body 22 is disk-shaped, and a motor (not shown) connected to a rotary shaft 32 rotates the head body 22 in the direction indicated with an arrow B. Air supply passages 34, 36, 37 are formed in the head body 22, and the air supply passages 34, 36, 37 communicate with air supply passages 38, 40, 41 that are formed in the rotary shaft 32. The air supply passage 38, 40, 41 connect to a pump 44 through regulators 42A, 42B, 42C, respectively.

The carrier 24 is disk-shaped and is arranged under the head body 22 coaxially with the head body 22. A concave 25 is formed at the bottom of the carrier 24, and the concave 25 contains an air-permeable porous board 52. An air chamber 27 is formed over the porous board 52, and the air chamber 27 communicates with an air supply passage 53 that communicates with the air supply passage 37. Compressed air is supplied from the pump 44 to the air chamber 27 via the air supply passages 41, 37, 53. Then, the air passes through the porous board 52 and it jets downward from the bottom of the porous board 52. This results in transmission of the pressure of the carrier 24 to a wafer 54 via a pressure air layer 55, and the wafer 54 is uniformly pressed against the polishing pad 16. Adjusting the air pressure by the regulator 42C controls the force of the wafer 54 which presses the polishing pad 16. If the carrier 24 presses the wafer 54 directly against the polishing pad 16 and there is some dust between the carrier 24 and the wafer 54, the force of the carrier 24 cannot uniformly be transmitted to the entire surface of the wafer 54. When the wafer 54 is pressed against the polishing pad 16 via the pressure air layer 55, the force of the carrier 24 can uniformly be transmitted to the entire surface of the wafer 54.

The wafer holding head 14 controls the pressure of the carrier 24 to move the carrier 24 vertically, and thereby controls the polishing pressure of the wafer 54 (the force that presses the wafer 54 against the polishing pad 16). For this reason, the control of the polishing pressure is easier than the control of the polishing pressure of the wafer 54 by directly controlling the pressure of the pressure air layer 55. In other words, the wafer holding head 14 is able to control the polishing pressure of the wafer 54 by controlling the vertical position of the carrier 24. The air, which jets from the porous board 52, flows out through a vent (not shown), which is formed in the retainer ring 28.

The porous board 52 has a number of vent holes therein, and it is composed of sintered ceramics for example.

The rubber sheet 30 is disk-shaped, and has a uniform thickness. The rubber sheet 30 is fixed to the head body 22 by a stopper 48 via an O-ring 46, and is divided into a central part 30A and a peripheral part 30B at the stopper 48. As described later, the central part 30A of the rubber sheet 30 presses the carrier 24, and the peripheral part 30B presses the retainer ring 28. In this embodiment, the rubber sheet 30 is employed as the elastic sheet, but the present invention may also use any kinds of sheet which is made of a material such as plastic that is elastically deformed under fluid pressure such as air pressure.

On the other hand, a space (the first space) 50 is formed under the head body 22, and the space 50 is made airtight by the rubber sheet 30 and the O-ring 46. The air supply passage 36 communicates with the space 50. When the compressed air is supplied into the space 50 through the air supply passage 36, the central part 30A of the rubber sheet 30 is elastically deformed under the air pressure to press the central part 30A against the top of the carrier 24. Thereby, the wafer 54 is pressed against the polishing pad 16. The adjustment of the air pressure by the regulator 42B results in the control of the pressure force of the wafer 54.

The guide ring 26 is cylindrical and is coaxially arranged under the head body 22. The guide ring 26 is fixed to the head body 22 via the rubber sheet 30. This results in the transmission of the rotational force from the head body 22 to the guide ring 26 via the rubber sheet 30. Reference numerals 56, 58 indicate O-rings for sealing.

A retainer ring 28 is arranged between the guide ring 26 and the carrier 24. The outer diameter of the retainer ring 28 is substantially equal to the inner diameter of the guide ring 26, and the retainer ring 28 is slidably supported on an inner peripheral surface 26A of the guide ring 26.

The retainer ring 28 has a plurality of straight grooves 60 which are formed at predetermined positions on the outer peripheral surface thereof. The straight grooves 60 are formed in a direction in which the retainer ring 28 moves, and the straight grooves 60 are engaged with pins 62 which are fixed to the guide ring 26. The retainer ring 28 is prevented from falling off from the guide ring 26, and the retainer ring 28 moves in such a direction as to press the polishing pad 16.

On the other hand, an annular space (a second space) 66 is formed at the lower periphery of the head body 22, and the space 66 is tightly closed by the periphery 30B of the rubber sheet 30 and the O-rings 46 and 56. The air supply passage 34 communicates with the space 66. When the compressed air is supplied into the space 66 from the air supply passage 34, the peripheral part 30B of the rubber sheet 30 is elastically deformed under the air pressure to press the circular top of the retainer ring 28. Thereby, the retainer ring 28 is pressed, and the circular bottom of the retainer ring 28 is pressed against the polishing pad 16. The adjustment of the air pressure by the regulator 42A permits control of the pressure force of the retainer ring 28.

A description will be given of the operation of the wafer holding head 14 of the wafer polishing apparatus 10 which is constructed in the above-mentioned manner.

First, the pump 44 is driven to supply the compressed air to the air chamber 27 through the air supply passages 41, 37, 53. A pressure fluid layer 55 is formed between the porous board 52 and the wafer 54, and the pressure fluid layer 55 transmits the pressure force of the career 24 uniformly to the entire surface of the wafer 54.

Then, the compressed air is supplied from the pump 44 into the space 50 through the air supply passages 40, 36, and the central part 30A of the rubber sheet 30 is elastically deformed by the inner air pressure to thereby press the carrier 24. The wafer 54 is pressed against the polishing pad 16 via the pressure air layer 55. The regulator 42B adjusts the air pressure to control the inner air pressure to desired pressure, so that the force of the wafer 54 which presses the polishing pad 16 can be constant.

Then, the compressed air is supplied from the pump 44 to the space 66 through the air supply passages 38, 34, and the peripheral part 30B of the rubber sheet 30 is elastically deformed by the inner air pressure to press the retainer ring 28, which is pressed against the polishing pad 16. In the case of a soft polishing pad (wherein the upper layer is made of hard forming polyurethane and the lower layer is made of sponge), the pressure force P1 against the polishing pad 16 per unit area of the wafer 54 and the pressure force P2 against the polishing pad 16 per unit area of the retainer ring 28 are set to $P1<P2$. Then, the wafer holding head 14 is rotated to start polishing the wafer 54.

In this embodiment, since the rubber sheet 30 is used to press the retainer ring 28, the retainer ring 28 can be elastically deformed more uniformly than an air bag and a tube. Moreover, since the guide ring 26 guides the retainer ring 28 so that the retainer ring 28 can freely move in a pressing direction, the retainer ring can be pressed under uniform pressure.

The polishing apparatus of this embodiment is able to polish the whole surface of the wafer 54 more uniformly than the conventional polishing apparatus which uses the air bag or tube. Moreover, the movement strokes of the retainer ring 28 are longer in the polishing apparatus of this embodiment than in the polishing apparatus which uses the diaphragm for the pressing means.

Figure 3:
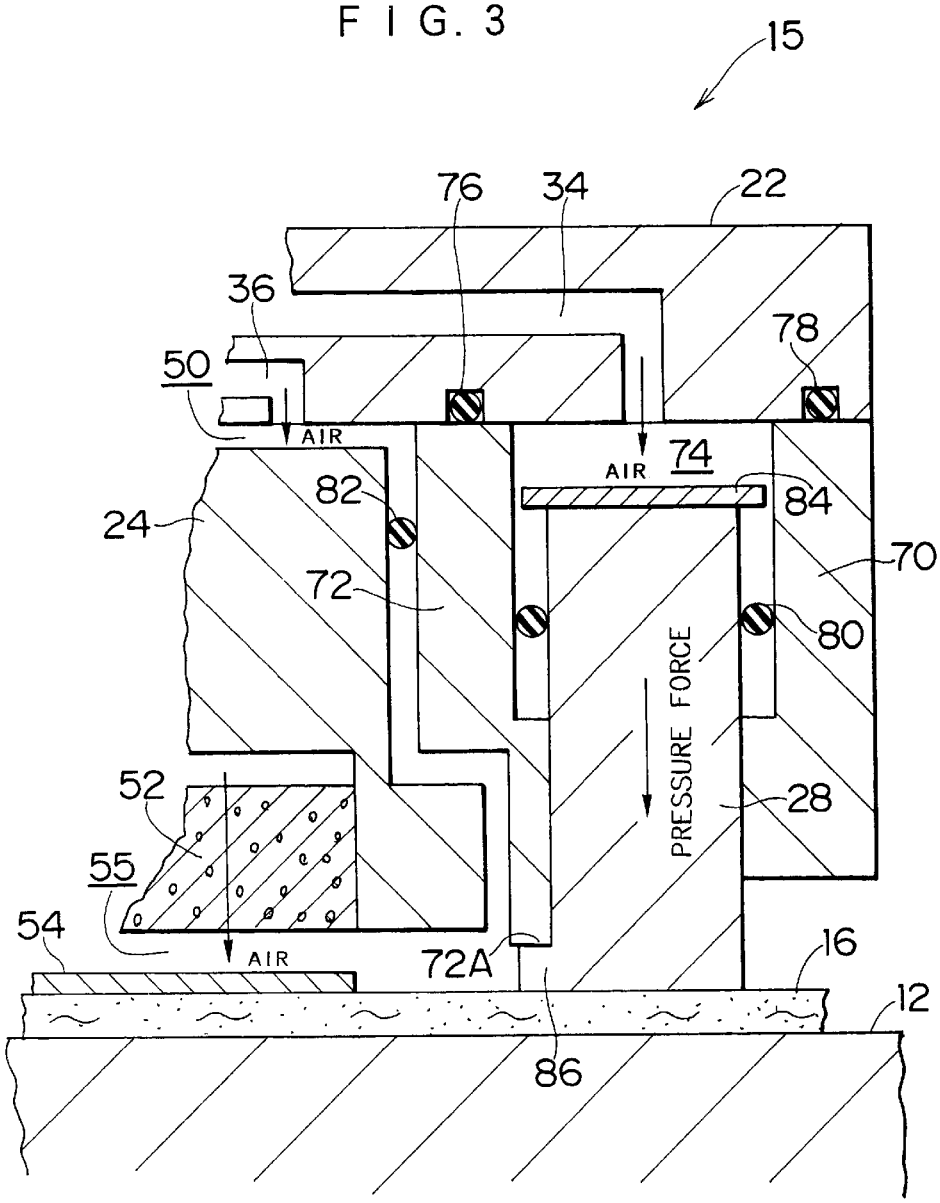
FIG. 3 is an enlarged sectional view illustrating the essential parts of the wafer polishing apparatus with the retainer ring according to the second embodiment.

FIG. 3 is an enlarged sectional view illustrating the essential parts of the second embodiment of the wafer holding head. Parts similar to those of the first embodiment in FIG. 2 will be denoted by the same reference numerals, and they will not be explained.

The wafer holding head 15 is provided with a guide ring 70 which slidably supports the outer peripheral surface of the retainer ring 28, and a guide ring 72 which slidably supports the inner peripheral surface of the retainer ring 28. The guide rings 70, 72 guide the retainer ring 28 so that the retainer ring 28 can freely move in the pressed direction.

A space (a second space) 74 is formed between the guide rings 70, 72, and the air supply passage 34 communicates with the space 74. Reference numerals 76, 78, 80 indicate O-rings which tightly closes the space 74, and the reference numeral 82 is an O-ring which tightly closes the space (the first space) 50. When the compressed air is supplied to the space 50 through the air supply passage 36, the carrier 24 is pressed downward by the air pressure to press the wafer 54 against the polishing pad 16 via the pressure air layer 55.

A stopper plate 84 is secured to the top of the retainer ring 28. The stopper plate 84 prevents the retainer ring 28 from falling off from the guide rings 70, 72. A stopper 86 is formed at the bottom of the retainer ring 28, and the stopper 86 projects inward. Since the stopper 86 is in contact with a bottom 72A of the guide ring 72, the upper position of the retainer ring 28 is regulated.

According to the wafer holding head 15 which is constructed in the above-mentioned manner, the supply of the compressed air to the space 74 through the air supply passage 34 causes the retainer ring 28 to be pressed downward. Consequently, the retainer ring 28 is pressed against the polishing pad 16. The adjustment of the air pressure of the compressed air results in control of the pressure force of the retainer ring 28 against the polishing pad 16.

In this embodiment, the body of a cylinder is composed of the guide rings 70 and 72, which form the space 74, and the head body 22. The retainer ring 28 functions as a rod to thereby construct an air cylinder mechanism. Thus, according to the present invention, the circumference of the retainer ring 28 can be pressed under constant pressure, and the movement strokes of the retainer ring 28 can be longer than the air bag and the tube. For this reason, the retainer ring 28 can be pressed satisfactorily.

In the first embodiment in FIG. 2, one rubber sheet 30 is divided into two to form the first space 50 at the central part and the second space 66 at the peripheral part, but the present invention should not be restricted to this.

Figure 4:
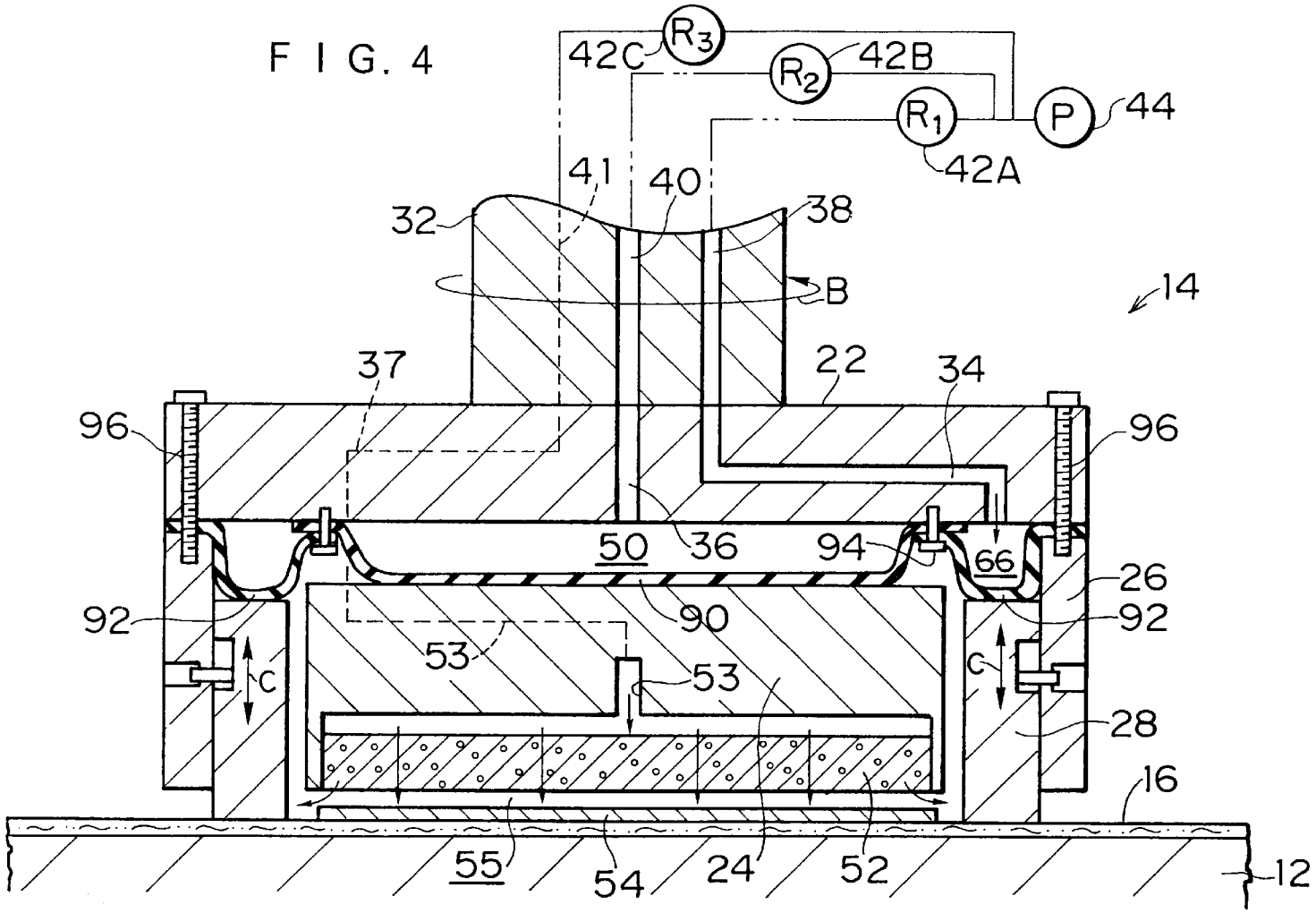
FIG. 4 is a sectional view illustrating another embodiment wherein an elastic sheet is composed of two rubber sheets.

For instance, as shown in FIG. 4, the rubber sheet may also be composed of a circular sheet 90, which is arranged inside the rubber sheet, and an annular sheet 92, which is arranged outside the circular sheet 90. In this case, the outer peripheral part of the sheet 90 and the inner peripheral part of the sheet 92 are on top of the other, and an annular stopper 94 goes through the overlapping part. The stopper 94 is attached to the head body 22. Thereby, the first space 50 is sealed by a self-sealing tendency of the overlapping part of the sheets 90, 92. On the other hand, the outer peripheral part of the sheet 92 is pinched between the head body 22 and the guide ring 26. The head body 22 is bolted to the guide ring 26 by a plurality of bolts 96 so that the outer peripheral part of the sheet 92 can be pinched between the head body 22 and the guide ring 26. The second space 66 is sealed by the self-sealing tendency of the outer peripheral part of the sheet 92.

Figure 5:
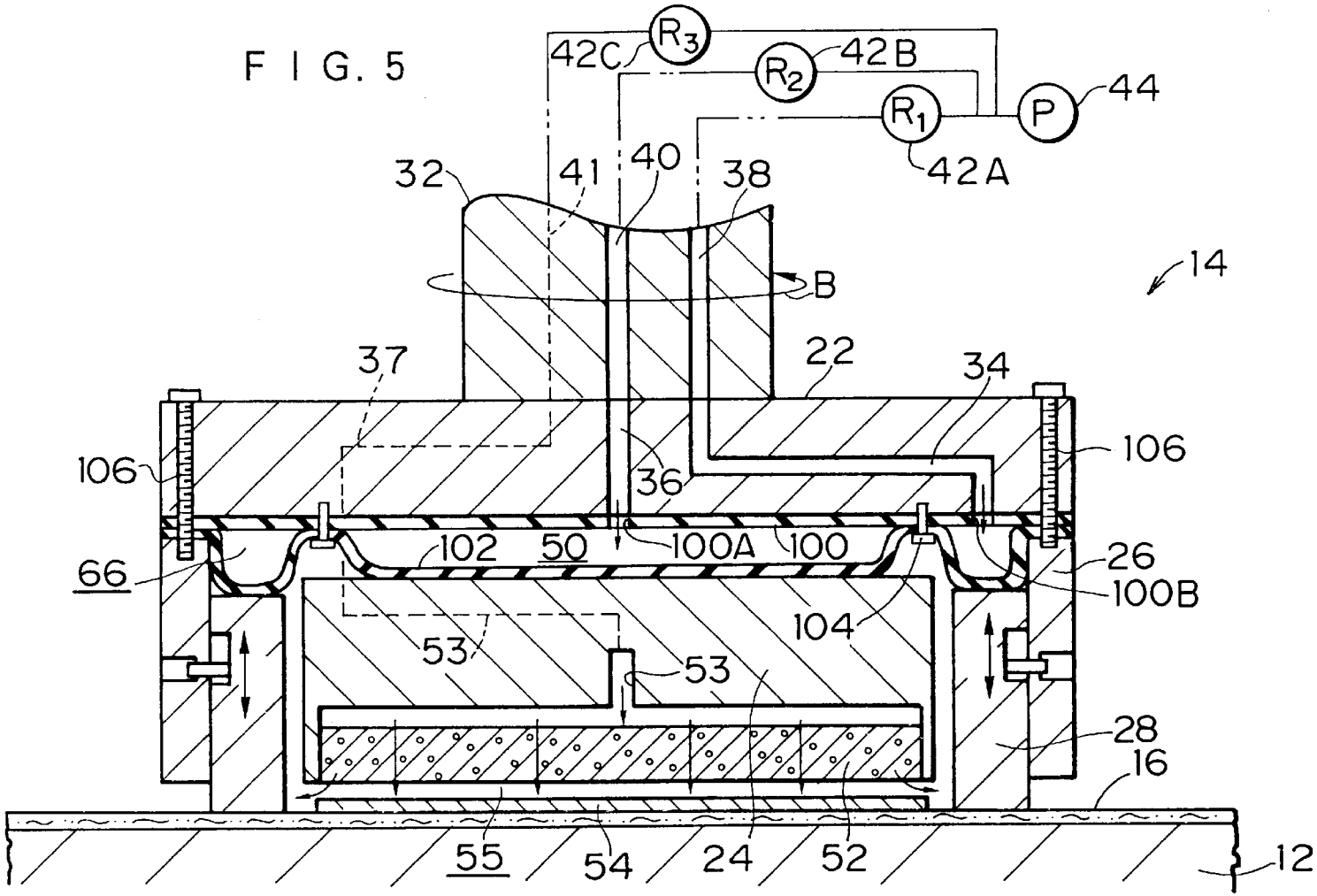
FIG. 5 is a sectional view illustrating another embodiment wherein an elastic sheet is composed of two rubber sheets.

As shown in FIG. 5, two rubber sheets 100, 102 may be stacked vertically. In this case, an annular stopper 104 goes through the sheets 100, 102, and the stopper 104 is attached to the head body 22 in order to form the first space 50. Thus, the first space 50 is sealed by the self-sealing tendency of the overlapping part of the sheets 100, 102. On the other hand, the outer peripheral parts of the sheets 100, 102 are pinched between the head body 22 and the guide ring 26. The head body 22 is bolted to the guide ring 26 with use of a plurality of bolts 106, and the head body 22 and the guide ring 26 pinch the outer peripheral parts of the sheets 100, 102. The second space 66 is sealed by the self-sealing tendency of the outer peripheral parts of the sheets 100, 102. An air introduction hole 100A is formed in the sheet 100 so as to introduce the air into the first space 50, and the air introduction hole 100A connects to the air supply passage 36. An air introduction hole 100B is also formed in the sheet 100 so as to introduce the air into the second space 66, and the air introduction hole 100B connects to the air supply passage 34.

Figure 6:
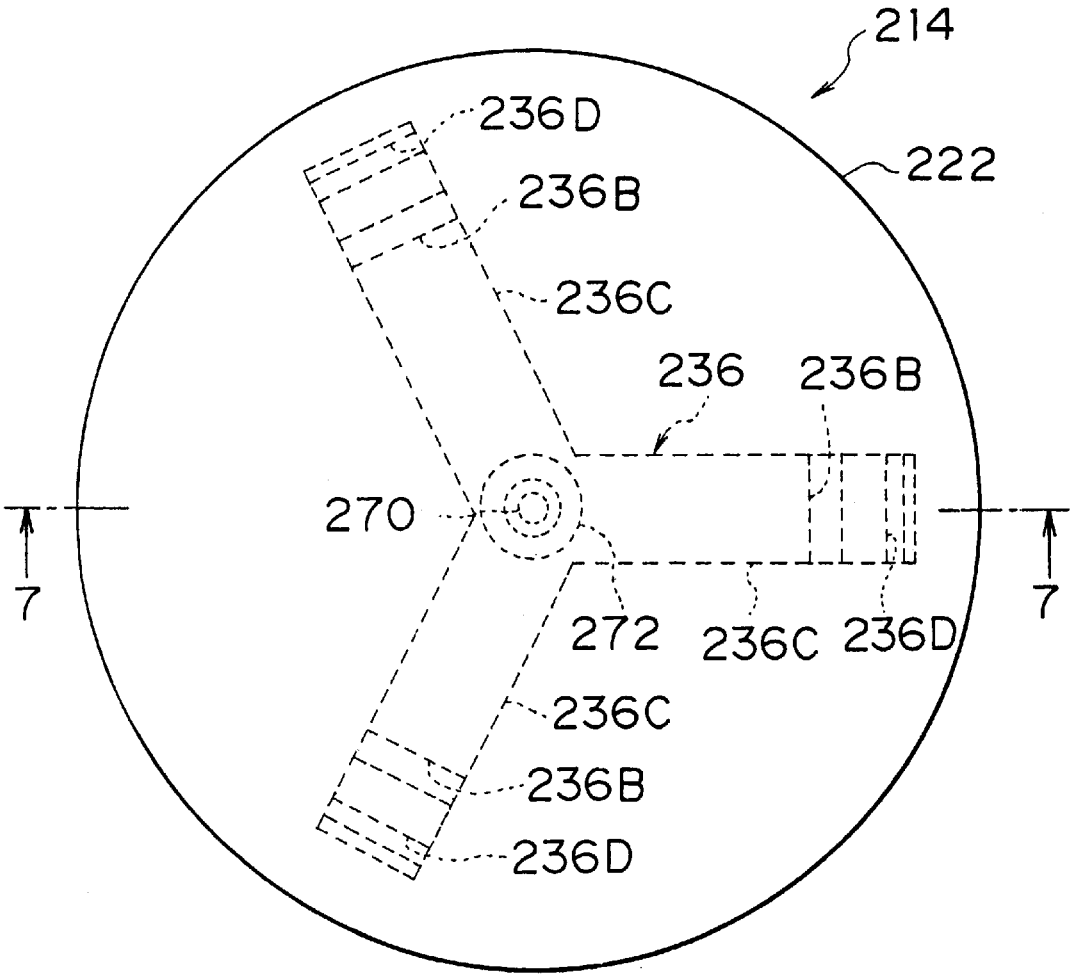
FIG. 6 is a plan view illustrating a wafer holding head according to the third embodiment.
Figure 7:
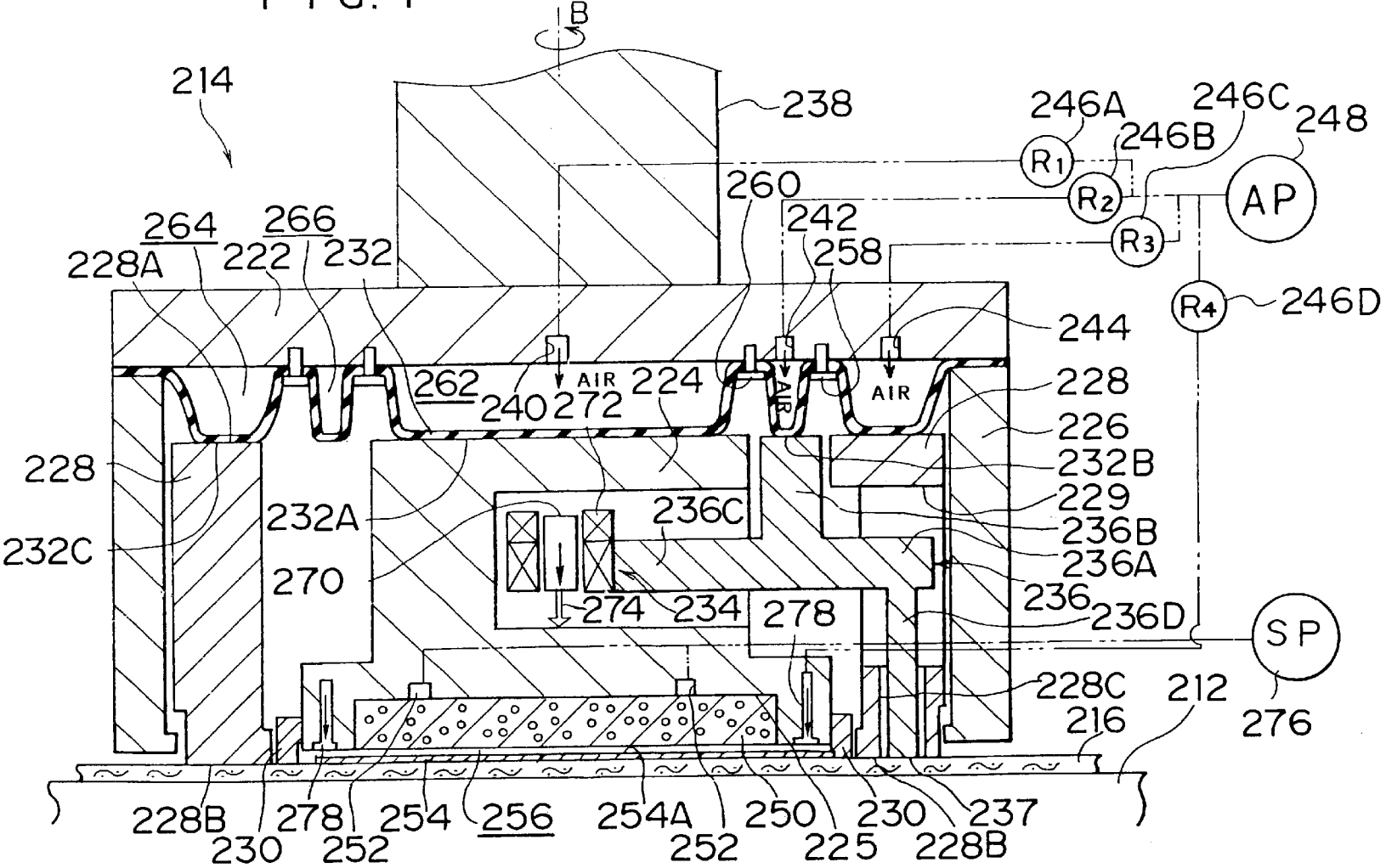
FIG. 7 is a longitudinal sectional view illustrating the wafer holding head in FIG. 6.

FIG. 6 is a plan view illustrating a holding head 214 which has a rubber sheet which is divided into three, and FIG. 7 is a longitudinal sectional view taken along line 7—7 of FIG. 6. The holding head 214 in FIG. 7 is comprised mainly of a head body 222, a carrier 224, a guide ring 226, a polishing surface adjusting ring 228, a retainer ring 230, a rubber sheet 232, a differential transformer 234, and a pressing member 236.

The head body 222 is disk-shaped, and a rotary shaft 238 connects to the top of the head body 222. The head body 222 is rotated in the direction of an arrow B by a motor (not shown) which connects to the rotary shaft 238. Air supply passages 240, 242, 244 are formed in the head body 222. The air supply passage 240 extends to the outside of the holding head 214 as indicated by long and short alternate lines in FIG. 6, and the air supply passage 240 connects to an air pump 248 via a regulator 246A. Likewise, the air supply passages 242, 244 extend to the outside of the holding head 214. The air supply passage 242 connects to a pump 240 via a regulator 246B, and the air supply passage 244 connects to a pump 240 via a regulator 246C.

The carrier 224 is shaped like a column, and it is coaxially arranged below the head body 222. A concave part 225 is formed at the bottom of the carrier 224, and the concave part 225 contains a breathable porous board 256. The porous board 250 communicates with air passages 252 which are formed in the carrier 224. As indicated by long and short alternate lines, the air passages 252 extend to the outside of the holding head 214, and they connect to a suction pump 276. Accordingly, if the suction pump 276 is driven, the porous board 250 absorbs and holds wafer 254. The porous board 250 has a number of vent holes therein, and it is composed of sintered ceramics for example.

A number of air supply passages 278 (only two passages are shown in FIG. 6) are formed in the carrier 224, and the exhaust nozzles of them are formed at the periphery of the bottom of the carrier 224. The air supply passages 278 extend to the outside of the holding head 214 as indicated by long and short alternate lines in the drawing, and they connect to the air pump 248 via a regulator 246D. Accordingly, the compressed air is jetted from the air pump 248 into an air chamber 256 between the porous board 250 and the wafer 254 through the air supply passages 278. Thereby, a pressure air layer is formed in the air chamber 256, and the pressure force of the carrier 224 is transmitted to the wafer 254 via the pressure air layer. The wafer 254 is pressed against the polishing pad 216 by the pressure force which is transmitted via the pressure air layer. The air jetted through the air supply passages are discharged to the outside through a vent (not shown) which is formed in the polishing surface adjusting ring 228.

On the other hand, one rubber sheet 232 is arranged between the head body 222 and the carrier 224. The rubber sheet 232 is shaped like a disk with uniform thickness. The rubber sheet 232 is fixed to the bottom of the head body 222 by large and small annular stoppers 258, 260. The rubber sheet 232 seals a gap between the stoppers 258, 260 and the head body 222. The rubber sheet 232 is divided into a central part 232A and an intermediate part 232B with the stopper 260 being a boundary. The rubber sheet 232 is also divided into the intermediate part 232B and an outer peripheral part 232C with the stopper 258 being a boundary. In other words, the rubber sheet 232 is divided into three by the stoppers 258, 260. The central part 232A presses the carrier 224, the intermediate part 232B presses the pressing member 236, and the outer peripheral part 232C functions as an air bag which presses the polishing surface adjusting ring 228.

The air supply passage 240 communicates with the air bag 262 which is specified by the central part 232A of the rubber sheet 232. When the compressed air is supplied to the air bag 262 through the air supply passage 240, the central part 232A of the rubber sheet 232 is elastically deformed to press the top of the carrier 224. This presses the wafer 254 against the polishing pad 216. The adjustment of the air pressure by the regulator 246A controls the pressure force (the polishing pressure) of the wafer 254.

The guide ring 226 is shaped like a cylinder, and it is coaxially arranged below the head body 222. The guide ring 226 is fixed to the head body 222 via the rubber sheet 232. The polishing surface adjusting ring 228 is arranged between the guide ring 226 and the carrier 224.

An annular air bag 264, which is specified by the outer peripheral part 232C of the rubber sheet 232 and the stopper 258, is formed above the polishing surface adjusting ring 228. The air supply passage 244 communicates with the air bag 264. The supply of the compressed air to the air bag 264 through the air supply passage 244 elastically deforms the outer peripheral part 232C of the rubber sheet 232 by the air pressure to thereby press an annular top surface 228A of the polishing surface adjusting ring 228. An annular bottom surface 228B of the polishing surface adjusting ring 228 is pressed against the polishing pad 216. The adjustment of the air pressure by the regulator 246C controls the pressure force of the polishing surface adjusting ring 228.

The pressing member 236 is arranged between the carrier 224 and the polishing surface adjusting ring 228. The pressing member 236 consists of a body 236A, a head 236B, support arms 236C, and legs 236D. The head 236B, the support arms 236C and the legs 236D of the pressing member 236 are formed as a unit at regular intervals as indicated by dotted lines in FIG. 6.

The body 236A of the pressing member 236 in FIG. 7 is arranged in an opening 229 which is formed in the polishing surface adjusting ring 228. The head 236B of the pressing member 236 is integrated with the body 236A, and the head 236B is arranged in a gap between the carrier 224 and the polishing surface adjusting ring 228.

An annular air bag 266, which is specified by the intermediate part 232B of the rubber sheet 232 and the stoppers 258, 260, is formed above the head 236B. The air supply passage 242 communicates with the air bag 266. The supply of the compressed air to the air bag 266 through the air supply passage 242 elastically deforms the intermediate part 232B of the rubber sheet 232 by the air pressure to thereby press the head 246B of the pressing member 236. This causes a bottom 247 of the leg 236D of the pressing member 236 to be pressed against the polishing pad 216. The adjustment of the air pressure by the regulator 246B controls the pressure force of the pressing member 236. The leg 236D is arranged in a hole 228C formed in the polishing surface adjusting ring 228. The base material of the pressing member 236 is amber, whose coefficient of thermal expansion is so small as to prevent the thermal expansion caused by polishing temperature. The bottom 237, which is pressed against the polishing pad 216, is coated with diamond in order to prevent it from being polished by the polishing pad 216.

On the other hand, the differential transformer 234 is provided at the end of the support arm 236C of the pressing member 236, and the differential transformer 234 detects the stock removal of the wafer 254. The differential transformer 234 consists of a core 270, a bobbin 272, and a contact 274. The bobbin 272 is fixed to the end of the support arm 236C of the pressing member 236, and the core 270 is arranged in the bobbin 272 in such a manner as to move vertically. The contact 274 is provided at the bottom of the core 270, and the contact 274 is in contact with the carrier 224. The bobbin 272 connects to an arithmetic unit (not shown), which calculates the stock removal of the wafer 254 in accordance with the vertical movement amount of the core 270 with respect to the bobbin 272.

The retainer ring 230 is fitted into the periphery of the lower part of the carrier 224 in such a manner as to move vertically. The retainer ring 230 comes into contact with the polishing pad 216 while the wafer 254 is being polished. The wafer 254 is moved horizontally by the rotational force of the polishing pad 216, and then the wafer 254 is pressed against the inner peripheral surface of the retainer ring 230. This prevents the wafer 254 from jumping out from the carrier 224.

Since the retainer ring 230 is made of resin, it is deformed from its original shape by the pressure force of the wafer 254, and the retainer ring 230 is elastically deformed in conformity with the peripheral edge of the wafer 254. The wafer 254 is pressed against the retainer ring 230 in the state wherein the surface of the wafer 254 is in contact with the retainer ring 230. It is also possible to use a metallic retainer ring which is elastically deformed by the pressure force.

A description will now be given of the operation of the wafer polishing apparatus which is constructed in the above-mentioned manner.

After the holding head 214 is raised, the suction pump 274 is driven to make the porous board 250 to absorb and hold the wafer 254 subject for polishing.

Then, the holding head 214 descends, and it stops at a position where the contact surface of the polishing surface adjusting ring 228 comes into contact with the polishing pad 216.

Then, an air pump 248 is driven to supply the compressed air to the space 256 through an air passage 278 to thereby form a pressure air layer in the space 256. At that time, the control of the regulator 246D adjusts the supply of the compressed air and sets the pressure of the pressure air layer to a preset pressure.

The compressed air is supplied from the pump 248 to the air bag 262 through the air passage 240, and the central part 232A of the rubber sheet 232 is elastically deformed by the inner air pressure to thereby press the carrier 224. The wafer 254 is pressed against the polishing pad 216 via the pressure air layer. The adjustment of the air pressure by the regulator 246A controls the inner air pressure to a desired pressure, and keeps the pressure force of the wafer 254 against the polishing pad 216 constant.

At the same time, the compressed air is supplied from the air pump 248 through the air passage 244, and the outer peripheral part 232C of the rubber sheet 232 is elastically deformed by the inner air pressure to press the polishing surface adjusting ring 228. The bottoms of the polishing surface adjusting ring 228 and the retainer ring 230 are pressed against the polishing pad 216. Then, the compressed air is supplied from the pump 240 to the air bag 266 through the air supply passage 242. The intermediate part 232B of the rubber sheet 232 is elastically deformed by the inner air pressure to press the pressing member 236. Consequently, the bottom 237 of the pressing member 236 is pressed against the polishing pad 216. Then, the turn table 212 and the holding head 214 are rotated to start polishing the wafer 254.

During the polishing, the wafer 254 is moved horizontally by the rotation of the polishing pad 216, and the wafer 254 is polished with the peripheral edge thereof being pressed against the retainer ring 230. At that time, the retainer ring 230 is elastically deformed in conformity with the peripheral edge of the wafer 254 by the pressure force from the wafer 254. Accordingly, the wafer 254 is pressed against the retainer ring 230 in the state wherein the surface of the wafer 254 is in contact with the retainer ring 230. This diffuses the pressure which is applied to the wafer 254 by the retainer ring 230, thus preventing the defects of the wafer such as chips.

On the other hand, the arithmetic unit calculates the stock removal of the wafer 254 during the polishing in accordance with the descending amount of the contact 274 of the differential transformer 234, that is, the descending amount of the core 270, in the state wherein the contact 274 is in contact with the carrier 224.

When the stock removal calculated by the arithmetic unit reaches a preset polishing ending point, the wafer polishing apparatus is stopped to finish polishing the wafer 254. The polishing of one wafer 254 is completed in this manner. The previously-described steps are repeated to polish the subsequent wafer 254.

In this embodiment, the rubber sheet is used for the elastic sheet, but it is also possible to use a metallic or plastic sheet which is elastically deformed by the pressure air to press the carrier and the retainer ring.

It is also possible to use a shape memory alloy whose displaced amount varies according to the temperature and control the heating temperature of the shape memory alloy to thereby control the displaced amount thereof, thus pressing the retainer ring and the carrier by a force which is generated by the displacement.

As set forth hereinabove, according to the present invention, the wafer polishing apparatus with the retainer ring supplies the pressure air to the first space and elastically deforms the central part of the elastic sheet under the air pressure to press the carrier, thereby pressing the wafer against the polishing pad. Then, the wafer polishing apparatus supplies the pressure air to the second space, and elastically deforms the periphery of the elastic sheet to press the retainer ring, thereby uniformly pressing the retainer ring against the polishing pad. Thus, the present invention uniformly polishes the whole surface of the wafer, and the movement strokes of the retainer ring are longer in the present invention than in the polishing apparatus which uses the diaphragm. For this reason, the retainer ring can be pressed satisfactorily.

According to the second invention of the present invention, the pressure air is supplied to the first space, and the air pressure directly presses the carrier, thereby pressing the wafer against the polishing pad. The pressure air is supplied to the second space, and the air pressure directly presses the retainer ring, thereby uniformly pressing the whole surface of the wafer. The movement strokes of the retainer ring are longer in the present invention than in the polishing apparatus which uses the diaphragm. For this reason, the retainer ring can be pressed satisfactorily.

It should be understood, however, that there is no intention to limit the invention to the specific forms disclosed, but on the contrary, the invention is to cover all modifications, alternate constructions and equivalents falling within the spirit and scope of the invention as expressed in the appended claims.

I claim:

1. A wafer polishing apparatus which presses a wafer against a rotating turn table to polish a face of the wafer, said wafer polishing apparatus comprising:

a rotary head body arranged opposite to said turn table;

a carrier contained in said head body in a manner that is vertically movable, said carrier supporting the wafer to press the wafer against said turn table;

a retainer ring contained in said head body in a manner that is vertically movable, said retainer ring concentrically arranged at the periphery of said carrier, said retainer ring coming into contact with said turn table and holding the periphery of the wafer during polishing;

an elastic sheet provided in a space in said head body above said carrier and said retainer ring;

a first space which presses said carrier and a second space which presses said retainer ring, said first and second spaces being formed in said head body; and wherein said elastic sheet is concentrically divided into at least a central part closing said first space and a peripheral part closing said second space and pressurized air supplied to said first and second spaces elastically deforming the central part and the peripheral part of said elastic sheet, respectively, such that the central part presses said carrier against said turn table and said peripheral part presses said retainer ring against said turn table.

2. The wafer polishing apparatus as defined in claim 1, wherein said elastic sheet is made of one of rubber, metal, and plastic.

3. The wafer polishing apparatus as defined in claim 1, wherein said elastic sheet is one sheet.

4. The wafer polishing apparatus as defined in claim 1, wherein an air jetting member is provided at the bottom of said carrier and jets the air to the other face of the wafer to thereby form a pressure fluid layer between said carrier and the wafer and press the wafer against said turn table via said pressure fluid layer.

5. The wafer polishing apparatus as defined in claim 1, wherein an air jetting member is provided at the bottom of said carrier and jets the air to the other face of the wafer to thereby form a pressure fluid layer between said carrier and the wafer and press the wafer against said turn table via said pressure fluid layer.

* * * * *